US009677579B2

(12) United States Patent
Ogawa

(10) Patent No.: US 9,677,579 B2
(45) Date of Patent: Jun. 13, 2017

(54) ACTUATOR UNIT

(71) Applicant: KAYABA INDUSTRY CO., LTD., Minato-ku, Tokyo (JP)

(72) Inventor: Takayuki Ogawa, Kanagawa (JP)

(73) Assignee: KYB Corporation, Tokyo (JP)

( * ) Notice: Subject to any disclaimer, the term of this patent is extended or adjusted under 35 U.S.C. 154(b) by 208 days.

(21) Appl. No.: 14/407,474

(22) PCT Filed: Aug. 6, 2013

(86) PCT No.: PCT/JP2013/071242
§ 371 (c)(1),
(2) Date: Dec. 12, 2014

(87) PCT Pub. No.: WO2014/027585
PCT Pub. Date: Feb. 20, 2014

(65) Prior Publication Data

US 2015/0152894 A1 Jun. 4, 2015

(30) Foreign Application Priority Data

Aug. 13, 2012 (JP) ..... 2012-179155

(51) Int. Cl.
*F15B 13/04* (2006.01)
*F15B 15/16* (2006.01)
(Continued)

(52) U.S. Cl.
CPC ..... *F15B 15/16* (2013.01); *B61F 5/245* (2013.01); *F15B 1/26* (2013.01); *F15B 11/028* (2013.01);
(Continued)

(58) Field of Classification Search
CPC .... F15B 11/028; F15B 13/021; F15B 13/044; F15B 2211/3058; F04B 2203/0207; F04B 2203/0209
See application file for complete search history.

(56) References Cited

U.S. PATENT DOCUMENTS

2008/0190104 A1* 8/2008 Bresie ..... F15B 7/006 60/476
2011/0192157 A1 8/2011 Ogawa

FOREIGN PATENT DOCUMENTS

EP 2133576 A2 12/2009
JP 55-94970 U1 7/1980
(Continued)

OTHER PUBLICATIONS

International Search Report and Written Opinion mailed Sep. 17, 2013, corresponding to International application No. PCT/JP2013/071242.

*Primary Examiner* — Michael Leslie
(74) *Attorney, Agent, or Firm* — Hauptman Ham, LLP

(57) ABSTRACT

An actuator according to the present invention includes a cylinder, a piston inserted into the cylinder to be free to slide, a rod that is inserted into the cylinder and connected to the piston, a rod side chamber and a piston side chamber defined by the piston within the cylinder, a tank, a first opening/closing valve provided in a first passage that connects the rod side chamber to the piston side chamber, a second opening/closing valve provided in a second passage that connects the piston side chamber to the tank, a pump that supplies a working fluid to the rod side chamber, a motor that drives the pump, an exhaust passage that connects the rod side chamber to the tank, and a passive valve that is provided in the exhaust passage and has a predetermined pressure/flow rate characteristic.

15 Claims, 4 Drawing Sheets

(51) Int. Cl.

| | |
|---|---|
| ***F15B 11/028*** | (2006.01) |
| ***F15B 1/26*** | (2006.01) |
| ***F15B 21/14*** | (2006.01) |
| ***B61F 5/24*** | (2006.01) |
| *F15B 15/17* | (2006.01) |

(52) U.S. Cl.

CPC ..... *F15B 21/14* (2013.01); *F15B 15/17* (2013.01); *F15B 2201/40* (2013.01); *F15B 2211/20515* (2013.01); *F15B 2211/20538* (2013.01); *F15B 2211/3058* (2013.01); *F15B 2211/30565* (2013.01); *F15B 2211/3138* (2013.01); *F15B 2211/31558* (2013.01); *F15B 2211/327* (2013.01); *F15B 2211/50518* (2013.01); *F15B 2211/633* (2013.01); *F15B 2211/6313* (2013.01); *F15B 2211/6651* (2013.01); *F15B 2211/6656* (2013.01); *F15B 2211/705* (2013.01); *F15B 2211/7053* (2013.01)

(56) References Cited

FOREIGN PATENT DOCUMENTS

| | | | |
|---|---|---|---|
| JP | 2-163502 | A | 6/1990 |
| JP | 2003-139108 | A | 5/2003 |
| JP | 2010-65797 | A | 3/2010 |
| JP | 2011-88623 | A | 5/2011 |
| JP | 2013-35527 | A | 2/2013 |
| WO | 2013/021963 | A1 | 2/2013 |

* cited by examiner

ACTUATOR UNIT

TECHNICAL FIELD

The present invention relates to an actuator.

BACKGROUND ART

An actuator is used in a railway vehicle, for example, with being interposed between a vehicle body and a truck in order to suppress vibration in a left-right direction relative to an advancing direction of the vehicle body.

JP2010-65797A discloses an actuator including: a telescopic body having a cylinder, a piston inserted into the cylinder to be free to slide, a rod that is inserted into the cylinder and connected to the piston, and a rod side chamber and a piston side chamber defined by the piston within the cylinder; a tank; a first opening/closing valve provided midway in a first passage that connects the rod side chamber to the piston side chamber; a second opening/closing valve provided midway in a second passage that connects the piston side chamber to the tank; a pump that supplies a fluid to the rod side chamber; a motor that drives the pump; an exhaust passage that connects the rod side chamber to the tank; and a variable relief valve provided midway in the exhaust passage.

According to this actuator, a direction of an output thrust is determined by appropriately opening and closing the first opening/closing valve and the second opening/closing valve, whereupon the pump is rotated by the motor at a fixed speed such that the fluid is supplied into the cylinder at a fixed flow rate. Meanwhile, an internal pressure of the cylinder is controlled by adjusting a relief pressure of the variable relief valve, and in so doing, a thrust of a desired magnitude can be output in a desired direction.

SUMMARY OF INVENTION

In this type of actuator, the variable relief valve is required to control the magnitude of the thrust. However, the variable relief valve is structurally extremely complicated and therefore large. Hence, a driver (a driving device) is required to drive the variable relief valve. Accordingly, the actuator increases in size, making it more difficult to install the actuator in a railway vehicle or the like, and moreover, an overall cost of the actuator increases, making the actuator uneconomical.

An object of the present invention is to provide a small, low cost actuator.

According to one aspect of the present invention, an actuator comprising, a cylinder, a piston inserted into the cylinder to be free to slide, a rod that is inserted into the cylinder and connected to the piston, a rod side chamber and a piston side chamber defined by the piston within the cylinder, a tank, a first opening/closing valve provided in a first passage that connects the rod side chamber to the piston side chamber, a second opening/closing valve provided in a second passage that connects the piston side chamber to the tank, a pump that supplies a working fluid to the rod side chamber, a motor that drives the pump, an exhaust passage that connects the rod side chamber to the tank; and a passive valve that is provided in the exhaust passage and has a predetermined pressure/flow rate characteristic.

DESCRIPTION OF EMBODIMENTS

An embodiment of the present invention will be described below with reference to the figures.

Figure 1:
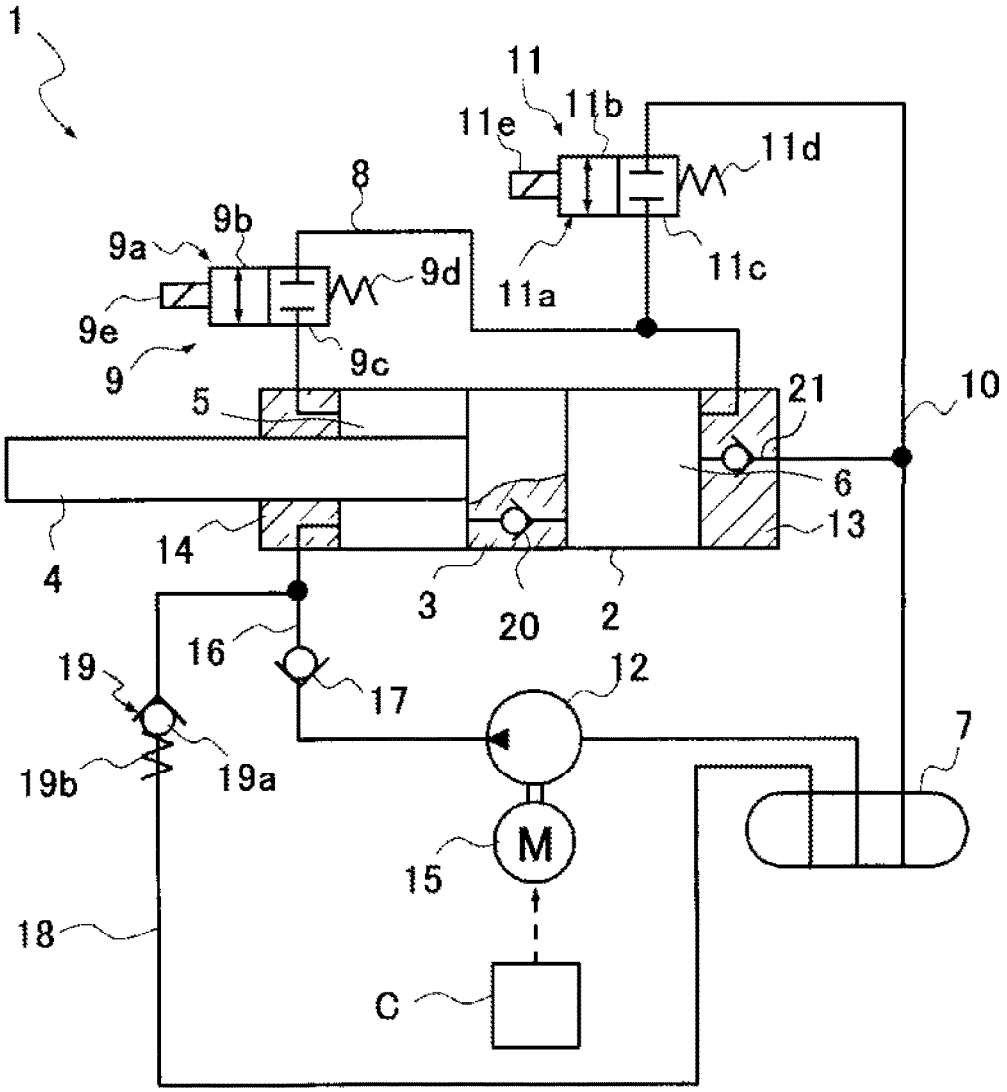
FIG. 1 is a circuit diagram showing an actuator according to an embodiment.

As shown in FIG. 1, an actuator 1 according to this embodiment is constituted by a single rod type actuator that includes a cylinder 2, a piston 3 inserted into the cylinder 2 to be free to slide, a rod 4 that is inserted into the cylinder 2 and connected to the piston 3, a rod side chamber 5 and a piston side chamber 6 defined by the piston 3 within the cylinder 2, a tank 7, a first opening/closing valve 9 provided midway in a first passage 8 that connects the rod side chamber 5 to the piston side chamber 6, a second opening/closing valve 11 provided midway in a second passage 10 that connects the piston side chamber 6 to the tank 7, a pump 12 that supplies a working fluid to the rod side chamber 5, a motor 15 that drives the pump 12, an exhaust passage 18 that connects the rod side chamber 5 to the tank 7, and a passive valve 19 provided midway in the exhaust passage 18. Further, a working liquid such as working oil is charged into the rod side chamber 5 and the piston side chamber 6 as the working fluid, and a gas is charged into the tank 7 in addition to the working liquid. A gas may be used as the working fluid used to operate the actuator 1 instead the aforesaid fluid. It should be noted that there is no need to set the tank 7 in a pressurized condition by compressing the gas charged therein.

The actuator 1 is driven to expand by driving the pump 12 using the motor 15 such that the working fluid is supplied into the cylinder 2 in a condition where the first passage 8 is set in a communicative condition by the first opening/closing valve 9 and the second opening/closing valve 11 is closed. Further, the actuator 1 is driven to contract by driving the pump 12 using the motor 15 such that the working fluid is supplied into the cylinder 2 in a condition where the second passage 10 is set in a communicative condition by the second opening/closing valve 11 and the first opening/closing valve 9 is closed.

The respective parts will now be described in detail. The cylinder 2 is formed in a tubular shape. A right end thereof in FIG. 1 is closed by a lid 13, and an annular rod guide 14 is attached to a left end thereof in FIG. 1. Further, the rod 4 inserted into the cylinder 2 to be free to move is inserted into the rod guide 14 to be free to slide. The rod 4 projects to the exterior of the cylinder 2 at one end, and another end is connected to the piston 3 inserted into the cylinder 2 to be free to slide.

A gap between an outer periphery of the rod 4 and the rod guide 14 is sealed by a seal member, not shown in the figures. As a result, the interior of the cylinder 2 is maintained in an airtight condition. As described above, working oil is charged as the working fluid into the rod side chamber 5 and the piston side chamber 6 defined within the cylinder 2 by the piston 3.

In the actuator 1, a sectional area of the rod 4 is set at half a sectional area of the piston 3 such that a pressure receiving surface area on the rod side chamber 5 side of the piston 3 is half a pressure receiving surface area on the piston side chamber 6 side of the piston 3. Hence, when a pressure in the rod side chamber 5 is set to be identical during expansion driving and contraction driving, an equal thrust is generated during both expansion and contraction, and an identical flow rate is obtained relative to a displacement amount of the actuator 1 on both the expansion and the contraction sides.

To describe this in more detail, when the actuator 1 is driven to expand, the rod side chamber 5 and the piston side chamber 6 communicate with each other such that the pressure in the rod side chamber 5 and a pressure in the piston side chamber 6 are equal. As a result, a thrust obtained by multiplying this pressure by a pressure receiving surface area difference between the rod side chamber 5 side and the piston side chamber 6 side of the piston 3 is generated. When the actuator 1 is driven to contract, on the other hand, communication between the rod side chamber 5 and the piston side chamber 6 is cut off such that the piston side chamber 6 communicates with the tank 7, and therefore a thrust obtained by multiplying the pressure in the rod side chamber 5 by the pressure receiving surface area on the rod side chamber 5 side of the piston 3 is generated. Hence, the thrust generated by the actuator 1 takes a value obtained by multiplying the pressure in the rod side chamber 5 by half the sectional area of the piston 3 during both expansion and contraction. Therefore, the thrust of the actuator 1 can be controlled by adjusting the pressure in the rod side chamber 5 to a target pressure during both expansion driving and contraction driving. The pressure receiving surface area on the rod side chamber 5 side of the piston 3 is set at half the pressure receiving surface area on the piston side chamber 6 side, and therefore, when identical thrust is generated on both the expansion and contraction sides, the pressure in the rod side chamber 5 is identical on both the expansion side and the contraction side, making control simple. Further, in this case, the flow rate relative to the displacement amount is also identical, and therefore an identical response is obtained on both the expansion and contraction sides. It should be noted that even when the pressure receiving surface area on the rod side chamber 5 side of the piston 3 is not set at half the pressure receiving surface area on the piston side chamber 6 side, the thrust can still be controlled on both the expansion and contraction sides of the actuator 1 using the pressure in the rod side chamber 5.

A left end of the rod 4 in FIG. 1 and the lid 13 that closes the right end of the cylinder 2 include attachment portions, not shown in the figures. The actuator 1 can be interposed between a vehicle body and an axle of the vehicle using these attachment portions.

The rod side chamber 5 and the piston side chamber 6 are connected by the first passage 8. The first opening/closing valve 9 is provided midway in the first passage 8. The first passage 8 connects the rod side chamber 5 and the piston side chamber 6 on the exterior of the cylinder 2, but may be provided in the piston 3.

The first opening/closing valve 9 is a solenoid opening/closing valve. The first opening/closing valve 9 includes a valve 9*a* having a communication position 9*b* and a cutoff position 9*c*, a spring 9*d* that biases the valve 9*a* to be switched to the cutoff position 9*c*, and a solenoid 9*e* which, when energized, switches the valve 9*a* to the communication position 9*b* against the spring 9*d*. When switched to the communication position 9*b*, the valve 9*a* of the first opening/closing valve 9 opens the first passage 8 such that the rod side chamber 5 communicates with the piston side chamber 6. When switched to the cutoff position 9*c*, the valve 9*a* of the first opening/closing valve 9 cuts off communication between the rod side chamber 5 and the piston side chamber 6.

The piston side chamber 6 and the tank 7 are connected by the second passage 10, and the second opening/closing valve 11 is provided midway in the second passage 10. The second opening/closing valve 11 is a solenoid opening/closing valve. The second opening/closing valve 11 includes a valve 11*a* having a communication position 11*b* and a cutoff position 11*c*, a spring 11*d* that biases the valve 11*a* to be switched to the cutoff position 11*c*, and a solenoid 11*e* which, when energized, switches the valve 11*a* to the communication position 11*b* against the spring 11*d*. When switched to the communication position 11*b*, the valve 11*a* of the second opening/closing valve 11 opens the second passage 10 such that the piston side chamber 6 communicates with the tank 7. When switched to the cutoff position 11*c*, the valve 11*a* of the second opening/closing valve 11 cuts off communication between the piston side chamber 6 and the tank 7.

The pump 12 is driven by the motor 15 to discharge the working oil in only one direction. A discharge port of the pump 12 is connected to the rod side chamber 5 by a supply passage 16, while an suction port communicates with the tank 7. The pump 12, when driven by the motor 15, suctions working oil from the tank 7 and supplies the working oil to the rod side chamber 5. The motor 15 is driven to rotate upon reception of a current supply from a controller C. Since the pump 12 discharges the working oil in only one direction, as described above, an operation to switch a rotation direction thereof is not required, and therefore a problem in which a discharge amount varies during a rotation switch does not arise. Hence, an inexpensive gear pump or the like can be used as the pump 12. Further, the rotation direction of the pump 12 is always the same direction, and therefore an operation to switch a rotation direction of the motor 15 serving as a drive source that drives the pump 12 is also unnecessary. Hence, the motor 15 does not require a high degree of responsiveness to a rotation direction switch, and therefore a correspondingly inexpensive motor may likewise be used as the motor 15.

A check valve 17 that prevents backflow of the working oil from the rod side chamber 5 to the pump 12 is provided midway in the supply passage 16.

Further, the rod side chamber 5 and the tank 7 are connected via the exhaust passage 18. The passive valve 19, which has a predetermined pressure/flow rate characteristic relative to the working fluid flowing from the rod side chamber 5 into the tank 7, is provided midway in the exhaust passage 18.

Figure 2:
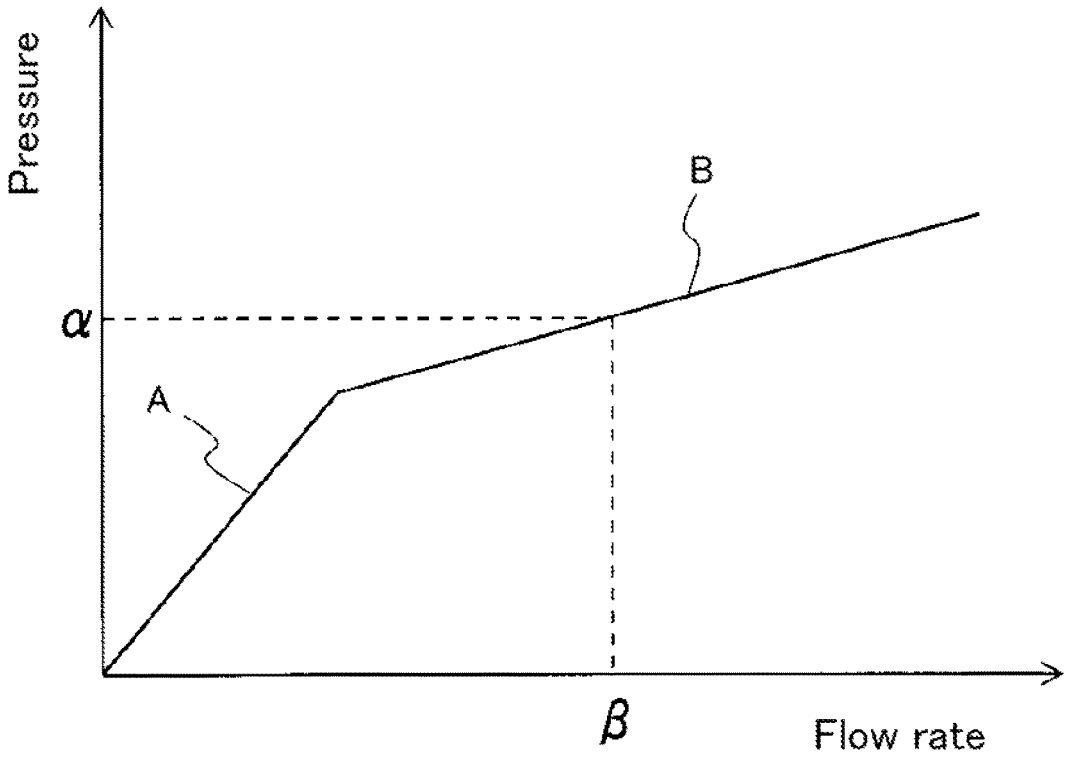
FIG. 2 is a view showing a pressure/flow rate characteristic of a passive valve according to this embodiment.

The passive valve 19 includes a valve body 19*a* and a spring 19*b* that biases the valve body 19*a* from a back surface side, and applies a predetermined resistance to a working oil flow when working oil is supplied thereto from the upstream side rod side chamber 5. As shown in FIG. 2, for example, the passive valve 19 has a pressure/flow rate characteristic according to which a pressure loss is determined uniformly in relation to a flow rate passing through the passive valve 19. When the valve body 19*a* opens such that the spring 19*b* is compressed by pressure from the upstream side, leading to a gradual increase in a degree of opening, or in other words when a flow passage area gradually increases, the pressure increases along a fixed gradient relative to the flow rate, as shown by a line A in FIG. 2. When the degree of opening reaches a maximum, the flow passage area does not increase further, and therefore the gradient becomes slightly gentler than that of the line A, as shown by a line B in FIG. 2. It should be noted that the pressure/flow rate characteristic of the passive valve 19 is not limited to the characteristic shown in FIG. 2, and any characteristic according to which the pressure loss is determined uniformly in relation to the flow rate may be employed.

The actuator 1 is provided with a rectifying passage 20 that allows the working oil to flow only from the piston side chamber 6 toward the rod side chamber 5, and an suction passage 21 that allows the working oil to flow only from the tank 7 toward the piston side chamber 6.

Next, operations of the actuator 1 will be described. As described above, when the actuator 1 is operated, the thrust on both the expansion and contraction sides of the actuator 1 can be controlled by controlling the pressure in the rod side chamber 5.

As a specific method, the thrust of the actuator 1 is controlled to a desired value by adjusting the pressure in the rod side chamber 5 using the pressure/flow rate characteristic of the passive valve 19.

For example, in a case where the actuator 1 is caused to output the desired thrust in the expansion direction, the first opening/closing valve 9 is set in the communication position 9*b* and the second opening/closing valve 11 is set in the cutoff position 11*c*, whereupon the motor 15 is driven such that the working oil is supplied from the pump 12 into the cylinder 2. Accordingly, the cylinder 2 is cut off from the tank 7 whereas the rod side chamber 5 and the piston side chamber 6 communicate with each other, and therefore the working oil is supplied to both chambers from the pump 12. As a result, the piston 3 is pressed leftward in FIG. 1, causing the actuator 1 to perform an expansion operation.

As described above, the thrust to be output by the actuator 1 and the pressure in the rod side chamber 5 have a linear relationship, and therefore a pressure in the rod side chamber 5 that corresponds to the thrust to be output serves as a target pressure. The target pressure is determined by calculation processing performed by the controller C. Further, although not shown in the figures, the thrust to be output by the actuator 1 may be input into the controller C from a control device of an upper order to the controller C, or calculated by the controller C in accordance with a predetermined control law. The pressure/flow rate characteristic of the passive valve 19 shown in FIG. 2 is used to set the pressure in the rod side chamber 5 at the target pressure. More specifically, a flow rate required to pass through the passive valve 19 is determined from the target pressure, whereupon the working oil is supplied to the passive valve 19 at the determined flow rate. To determine the flow rate from the target pressure, when a tank pressure is at atmospheric pressure and the target pressure is $\alpha$, for example, the flow rate can be determined by reading a flow rate $\beta$ corresponding to the pressure $\alpha$ from the pressure/flow rate characteristic diagram of the passive valve 19, shown in FIG. 2. The flow rate corresponding to the target pressure may be determined by having the controller C perform a map calculation using the pressure/flow rate characteristic, or may be determined using a function having the target pressure as a parameter. In so doing, the pressure loss in the passive valve 19 becomes equal to the target pressure. In other words, by supplying the working oil at the flow rate determined in the manner described above, an upstream side pressure in the passive valve 19 increases above atmospheric pressure, i.e. the tank pressure, by an amount corresponding to the target pressure, whereby the pressure in the rod side chamber 5 upstream of the passive valve 19 reaches the target pressure. To describe this in more detail, since the second opening/closing valve 11 is in the cutoff position 11*c*, the working oil discharged from the pump 12 does not flow into the tank 7 via the cylinder 2, and instead, the entire flow discharged from the pump 12 is returned to the tank 7 through the passive valve 19. Accordingly, the pressure in the rod side chamber 5 becomes higher than the pressure in the tank 7 by an amount corresponding to the pressure loss in the passive valve 19. When a discharge flow rate of the pump 12 at which the pressure in the rod side chamber 5 can be set at the target pressure is determined, a rotation speed of the motor 15 is determined uniformly. By controlling the motor 15 to the determined rotation speed, the pressure in the rod side chamber 5 is adjusted to the target pressure, and as a result, the thrust of the actuator 1 is controlled to the desired magnitude. Hence, the controller C determines the flow rate of the passive valve 19 from the target pressure, determines the rotation speed of the motor 15 from the flow rate, and controls the motor 15 to the determined rotation speed. The rotation speed of the motor 15 can be controlled by monitoring the rotation speed of the motor 15 and performing feedback control. When the motor 15 is an AC motor or a brushless motor, a sensor is required to sense a position of a rotor of the motor 15, and therefore the rotation speed can be monitored using this sensor. When the motor 15 includes a brush and does not have a sensor to monitor the rotation speed, a sensor may be provided separately to monitor the rotation speed. When the tank pressure is not at atmospheric pressure, a flow rate corresponding to a pressure that corresponds to a differential pressure between the target pressure and the tank pressure may be read from the pressure/flow rate characteristic diagram shown in FIG. 2, whereupon the rotation speed of the motor 15 can be controlled to cause the pump 12 to discharge the read flow rate. In so doing, the pressure loss in the passive valve 19 becomes equal to the difference between the target pressure and the tank pressure such that the upstream side pressure of the passive valve 19 increases beyond the tank pressure by an amount corresponding to the difference. As a result, the pressure in the rod side chamber 5 upstream of the passive valve 19 reaches the target pressure.

Conversely, in a case where the actuator 1 is caused to output the desired thrust in the contraction direction, the first opening/closing valve 9 is set in the cutoff position 9*c* and the second opening/closing valve 11 is set in the communication position 11*b*, whereupon the motor 15 is driven such that the working oil is supplied from the pump 12 into the cylinder 2. Accordingly, the piston side chamber 6 and the tank 7 communicate with each other whereas the rod side chamber 5 is cut off from the piston side chamber 6, and therefore the working oil is supplied only to the rod side chamber 5 from the pump 12. As a result, the piston 3 is pressed rightward in FIG. 1, causing the actuator 1 to perform a contraction operation.

Likewise in this case, the thrust to be output by the actuator 1 and the pressure in the rod side chamber 5 have a linear relationship, as described above, and therefore the pressure in the rod side chamber 5 that corresponds to the thrust to be output serves as the target pressure. The pressure/flow rate characteristic of the passive valve 19 may be used similarly to the manner described above to set the pressure in the rod side chamber 5 at the target pressure. Likewise in this case, since the first opening/closing valve 9 is in the cutoff position 9*c*, the working oil discharged from the pump 12 does not flow into the tank 7 via the cylinder 2, and instead, the entire flow is returned to the tank 7 through the passive valve 19. Hence, by determining the discharge flow rate of the pump 12, determining the rotation speed of the motor 15 from the discharge flow rate, and controlling the motor 15 to the determined rotation speed, in a similar manner to that described above, the pressure in the rod side chamber 5 is adjusted to the target pressure, and as a result, the thrust of the actuator 1 is controlled to the desired magnitude.

When the actuator 1 expands, a working oil deficiency occurs in the cylinder 2, and therefore working oil is supplied into the cylinder 2 from the pump 12. Further, when the actuator 1 contracts, the amount of working oil in the cylinder 2 becomes excessive, and therefore the working oil is discharged from the cylinder 2 into the tank 7 through the exhaust passage 18. In other words, as the actuator 1 expands and contracts, the flow rate passing through the passive valve 19 varies, and therefore, when an expansion/contraction speed of the actuator 1 increases, a control response obtained while causing the pressure in the rod side chamber 5 to follow the target pressure deteriorates. Hence, by providing a pressure sensor to detect the pressure in the rod side chamber 5 and controlling the rotation speed of the motor 15 by feeding back the pressure in the rod side chamber 5, an ability of the pressure in the rod side chamber 5 to keep pace with the target pressure can be improved.

As a second specific method of operating the actuator 1, the thrust of the actuator may be controlled to a desired value by controlling a torque of the motor 15 in order to adjust the pressure in the rod side chamber 5.

In a case where the actuator 1 is caused to output the desired thrust in the expansion direction, the first opening/closing valve 9 is set in the communication position 9*b* and the second opening/closing valve 11 is set in the cutoff position 11*c*, whereupon the motor 15 is driven such that the working oil is supplied from the pump 12 into the cylinder 2. Accordingly, the cylinder 2 is cut off from the tank 7 whereas the rod side chamber 5 and the piston side chamber 6 communicate with each other, and therefore the working oil is supplied to both chambers from the pump 12. As a result, the piston 3 is pressed leftward in FIG. 1, causing the actuator 1 to perform an expansion operation.

By having the controller C adjust the torque of the motor 15 together with this operation, the pressure in the rod side chamber 5 is adjusted such that the value obtained by multiplying the pressure in the rod side chamber 5 by the pressure receiving surface area difference between the piston side chamber 6 side and the rod side chamber 5 side of the piston 3 corresponds to the desired thrust. The pump 12 is driven by the torque of the motor 15, and the pump 12 receives the pressure in the rod side chamber 5. Therefore, by adjusting the torque of the motor 15, which is proportionate to the discharge pressure of the pump 12, the pressure in the rod side chamber 5 can be controlled.

Figure 3:
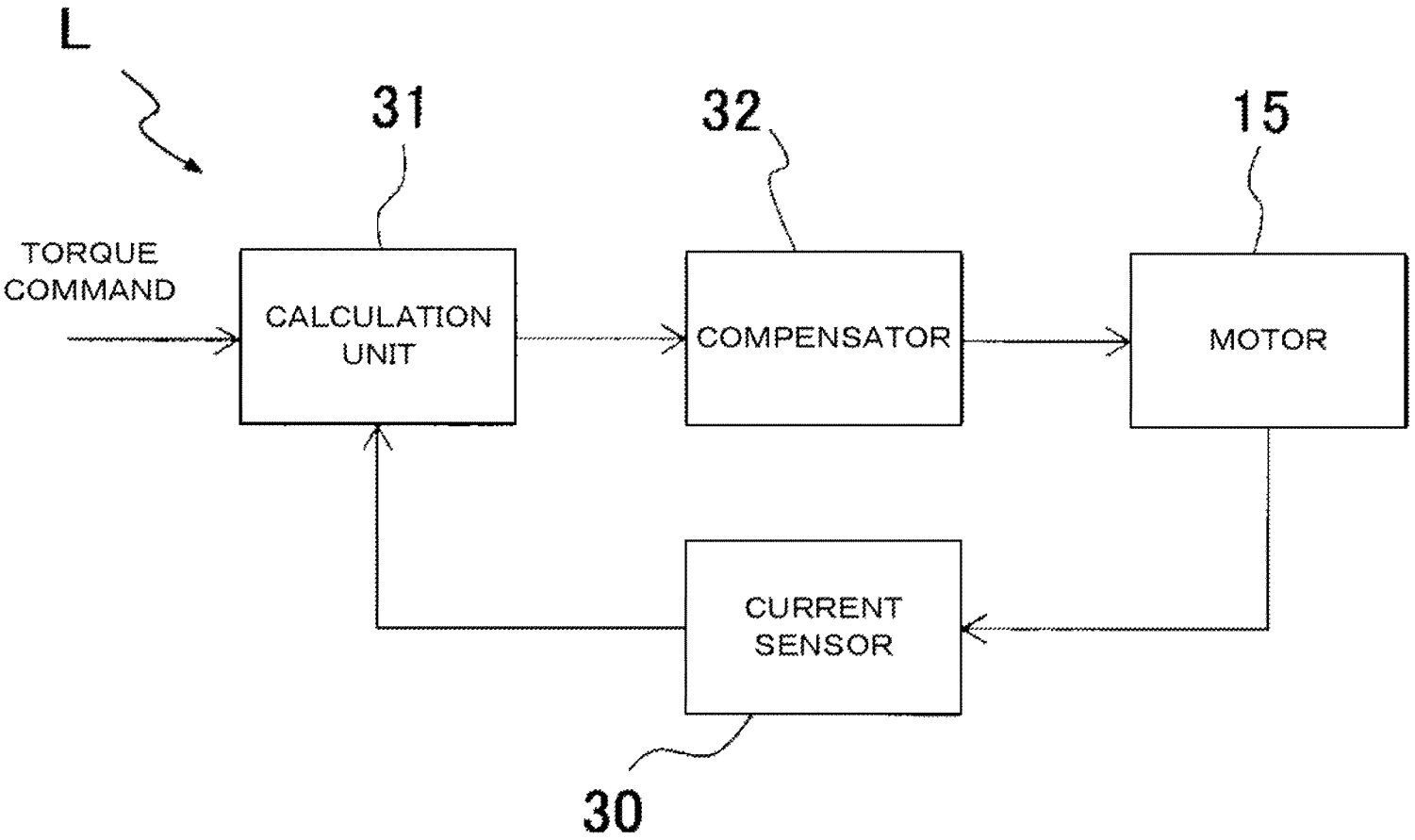
FIG. 3 is a view showing an example of a current loop according to this embodiment.

More specifically, as shown in FIG. 3, the controller C includes a current loop L that controls a current flowing through the motor 15 upon reception of an input torque command. The current loop L includes a current sensor 30 that detects a current flowing through a winding, not shown in the figure, of the motor 15, a calculation unit 31 that calculates a deviation between the torque command and the current detected by the current sensor 30, and a compensator 32 that generates a current command from the deviation determined by the calculation unit 31. The compensator 32 performs conventional compensation such as proportional integral compensation or proportional differential integral compensation, for example, but may perform another type of compensation.

Figure 4:
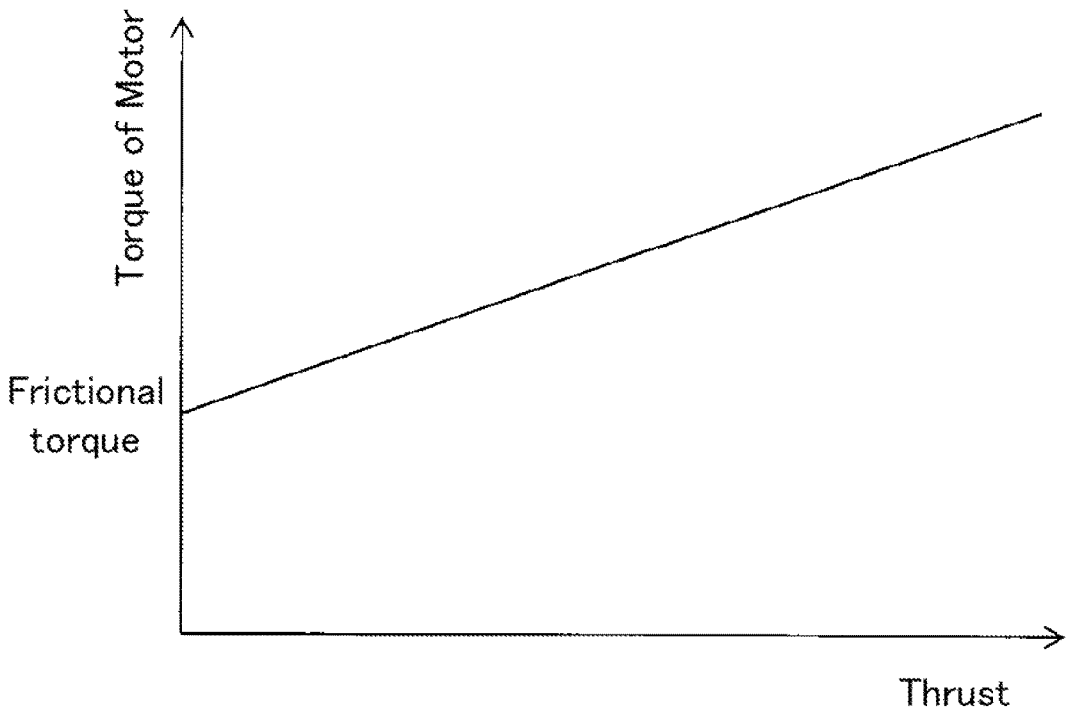
FIG. 4 is a view showing a relationship between a thrust generated by the actuator and a torque generated by a motor according to this embodiment.

The controller C determines the target pressure, i.e. the pressure in the rod side chamber 5 corresponding to the thrust to be output by the actuator 1, determines a required torque, which is a torque required to realize the target pressure, and determines a current command for realizing the required torque as the torque command. It should be noted that since the target pressure can be determined from the thrust, the required torque can be determined from the target pressure, and the torque command serving as the current command can be determined from the required torque, the controller C may, in actuality, determine the torque command directly from the thrust using the thrust as a parameter. More specifically, as shown in FIG. 4, a relationship between the torque of the motor 15 and the thrust can be approximated by a linear expression having a frictional torque of the motor 12 as an intercept, and therefore the torque command can be determined easily from the thrust. The thrust and the torque command are then input into the current loop L described above, whereupon a current is supplied to the motor 15 in order to control the torque of the motor 15 in accordance with the torque command. Thus, the pressure in the rod side chamber 5 is adjusted to the target pressure, and as a result, the thrust output by the actuator 1 is controlled to a thrust of the desired magnitude.

Conversely, in a case where the actuator 1 is caused to output the desired thrust in the contraction direction, the first opening/closing valve 9 is set in the cutoff position 9*c* and the second opening/closing valve 11 is set in the communication position 11*b*, whereupon the motor 15 is driven such that working oil is supplied from the pump 12 into the cylinder 2. Accordingly, the piston side chamber 6 and the tank 7 communicate with each other whereas the rod side chamber 5 is cut off from the piston side chamber 6, and therefore the working oil is supplied only to the rod side chamber 5 from the pump 12. As a result, the piston 3 is pressed rightward in FIG. 1, causing the actuator 1 to perform a contraction operation.

By having the controller C adjust the torque of the motor 15 together with this operation, in a similar manner to that described above, the pressure in the rod side chamber 5 is adjusted such that the value obtained by multiplying the pressure in the rod side chamber 5 by the pressure receiving surface area difference between the piston side chamber 6 side and the rod side chamber 5 side of the piston 3 corresponds to the desired thrust.

Hence, the actuator 1 is capable of generating thrust in both the expansion direction and the contraction direction, and by providing the passive valve 19, the thrust can be controlled easily without the use of a variable relief valve. In the actuator 1 according to this embodiment, the small and simply configured passive valve 19 is used, and therefore a driver is not required. In comparison with a conventional actuator, therefore, the actuator 1 can be reduced in both size and cost. As a result, the actuator 1 can be installed in a railway vehicle or the like with far greater ease, leading to an improvement in usefulness.

Further, the flow rate can be calculated from the pressure, and therefore an override characteristic of the passive valve 19 does not have an effect. As a result, a small, inexpensive passive valve can be used.

The pump 12 discharges in only one direction, and therefore, since there is no need to be concerned about capacity variation during a rotation switch, an inexpensive pump can be used as the pump 12. Likewise with regard to the motor 15 serving as the drive source of the pump 12, a high degree of responsiveness during a rotation direction switch is not required, and therefore an inexpensive motor can be used as the motor 15.

Further, when the first opening/closing valve 9 and the second opening/closing valve 11 are both set in the communication positions 9*b*, 11*b*, the working oil discharged from the pump 12 can be returned to the tank 7 via the cylinder 2, and therefore the actuator 1 can be unloaded. The working oil that is supplied from the pump 12 during unloading and flows as the actuator 1 expands and contracts passes through the rod side chamber 5 and the piston side chamber 6 in that order, and is ultimately recirculated to the tank 7. Hence, gas that infiltrates the rod side chamber 5 or the piston side chamber 6 can be discharged independently into the tank 7, and therefore a reduction in responsiveness during thrust generation can be prevented. Furthermore, there is no need to perform frequent maintenance for the purpose of performance recovery, and therefore reductions in labor and cost can be realized with respect to maintenance.

Moreover, as described above, the working oil flow passes through the rod side chamber 5 and the piston side chamber 6 in that order, and is ultimately recirculated to the tank 7, and therefore pressure does not invade the rod side chamber 5 and the piston side chamber 6. Hence, there is no need to provide a low pressure priority type shuttle valve in order to stabilize the thrust, and therefore a hammering sound generated by a low pressure priority type shuttle valve is eliminated, leading to an improvement in a quietness of the actuator 1. As a result, when the actuator 1 is installed in a vehicle, vehicle passengers are not disturbed and so on.

Furthermore, the actuator 1 according to this embodiment is provided with the rectifying passage 20 and the suction passage 21. Accordingly, when the actuator 1 is forcibly caused to expand or contract by an external force in a condition where driving of the pump 12 is stopped with both the first opening/closing valve 9 and the second opening/closing valve 11 set in their respective cutoff positions 9*c*, 11*c* such that the working oil is pushed out of the cylinder 2 by the expansion/contraction and discharged into the tank 7 through the passive valve 19, leading to a working oil deficiency in the cylinder 2, working oil is supplied into the cylinder 2 from the tank 7 through the suction passage 21. The actuator 1 according to this embodiment can therefore also function as a passive damper that generates a damping force corresponding to the pressure loss in the passive valve 19. In other words, the actuator 1 can exhibit a passive damper function as a failsafe when the pump 12 is stopped while the first opening/closing valve 9 and the second opening/closing valve 11 are in their respective cutoff positions 9*c*, 11*c*, and as a result, an expansion/contraction failure does not occur.

Moreover, in this embodiment, the check valve 17 is provided midway in the supply passage 16 downstream of the pump 12, and therefore backflow of the working oil from the rod side chamber 5 into the pump 12 can be prevented even when the actuator 1 is forcibly caused to expand or contract by an external force. As a result, a thrust equal to or greater than a thrust generated by the torque of the motor 15 can be obtained.

Embodiments of this invention were described above, but the above embodiments are merely examples of applications of this invention, and the technical scope of this invention is not limited to the specific constitutions of the above embodiments.

This application claims priority based on Japanese Patent Application No. 2012-179155 filed with the Japan Patent Office on Aug. 13, 2012, the entire contents of which are incorporated into this specification.

The invention claimed is:

1. An actuator unit, comprising:

a cylinder;

a piston inserted into the cylinder to be free to slide;

a rod that is inserted into the cylinder and connected to the piston;

a rod side chamber and a piston side chamber defined by the piston within the cylinder;

a tank;

a first opening/closing valve provided in a first passage that connects the rod side chamber to the piston side chamber;

a second opening/closing valve provided in a second passage that connects the piston side chamber to the tank;

a pump configured to supply a working fluid to the rod side chamber;

a motor configured to drive the pump;

an exhaust passage that connects the rod side chamber to the tank;

a passive valve that is provided in the exhaust passage and has a predetermined pressure/flow rate characteristic to cause a flow rate of the working fluid discharged from the rod side chamber to the tank to be increased with an increase in an opening degree of the passive valve caused by an increase in a pressure of the rod side chamber; and a controller configured to control a rotation speed of the motor based on the pressure/flow rate characteristic of the passive valve to control an output thrust of the actuator unit.

2. The actuator unit as defined in claim 1, wherein, in the pressure/flow rate characteristic, the flow rate of the working fluid is increased proportionally with the increase in the pressure of the rod side chamber.

3. The actuator unit as defined in claim 1, wherein, in the pressure/flow rate characteristic, the degree of the increase in the pressure of the rod side chamber when the flow rate of the working fluid is more than a predetermined flow rate is smaller than that when the flow rate of the working fluid is less than the predetermined flow rate.

4. The actuator unit as defined in claim 1, wherein the actuator unit is configured as a damper that is configured to generate a damping force corresponding to the pressure/flow rate characteristic of the passive valve when the pump is stopped.

5. The actuator unit as defined in claim 1, further comprising:

a suction passage configured to cause the working fluid to flow only from the tank toward the piston side chamber; and a rectifying passage configured to cause the working fluid to flow only from the piston side chamber toward the rod side chamber.

6. The actuator unit as defined in claim 1, further comprising a check valve between the pump and the rod side chamber to prevent the working fluid from flowing from the rod side chamber toward the pump.

7. The actuator unit according to claim 1, wherein the first opening/closing valve and the second opening/closing valve are solenoid opening/closing valves, which, when not energized, are biased to a cutoff position by a spring.

8. An actuator unit, comprising:

a cylinder;

a piston inserted into the cylinder to be free to slide;

a rod that is inserted into the cylinder and connected to the piston;

a rod side chamber and a piston side chamber defined by the piston within the cylinder;

a tank;

a first opening/closing valve provided in a first passage that connects the rod side chamber to the piston side chamber;

a second opening/closing valve provided in a second passage that connects the piston side chamber to the tank;

a pump configured to supply a working fluid to the rod side chamber;

a motor configured to drive the pump;

an exhaust passage that connects the rod side chamber to the tank;

a passive valve that is provided in the exhaust passage and has a predetermined pressure/flow rate characteristic to cause a flow rate of the working fluid discharged from the rod side chamber to the tank to be increased with an increase in an opening degree of the passive valve caused by an increase in a pressure of the rod side chamber; and a controller configured to control a torque of the motor based on a target pressure in the cylinder to control an output thrust of the actuator unit.

9. The actuator unit according to claim 8, wherein, in the pressure/flow rate characteristic, the flow rate of the working fluid is increased proportionally with the increase in the pressure of the rod side chamber.

10. The actuator unit according to claim 8, wherein, in the pressure/flow rate characteristic, the degree of the increase in the pressure of the rod side chamber when the flow rate of the working fluid is more than a predetermined flow rate is smaller compared with that when the flow rate of the working fluid is less than the predetermined flow rate.

11. The actuator unit according to claim 8, wherein the actuator unit is configured as a damper that is configured to generate a damping force corresponding to the pressure/flow rate characteristic of the passive valve when the pump is stopped.

12. The actuator unit according to claim 8, further comprising a current loop configured to control the motor, wherein the controller is configured to control the motor by determining a torque command to be applied to the current loop from the target pressure in the cylinder.

13. The actuator unit according to claim 8, further comprising a suction passage configured to cause the working fluid to flow only from the tank toward the piston side chamber; and a rectifying passage configured to cause the working fluid to flow only from the piston side chamber toward the rod side chamber.

14. The actuator unit according to claim 8, further comprising a check valve between the pump and the rod side chamber to prevent the working fluid from flowing from the rod side chamber toward the pump.

15. The actuator unit according to claim 8, wherein the first opening/closing valve and the second opening/closing valve are solenoid opening/closing valves, which, when not energized, are biased to a cutoff position by a spring.

* * * * *